US011820122B2

(12) United States Patent
Melotti

(10) Patent No.: US 11,820,122 B2
(45) Date of Patent: Nov. 21, 2023

(54) DRYER UNIT FOR A PRINTING MACHINE AND PRINTING MACHINE

(71) Applicant: BOBST BIELEFELD GMBH, Bielefeld (DE)

(72) Inventor: Renzo Melotti, Sala Monferrato (IT)

(73) Assignee: BOBST BIELEFELD GMBH, Bielefeld (DE)

( * ) Notice: Subject to any disclaimer, the term of this patent is extended or adjusted under 35 U.S.C. 154(b) by 0 days.

(21) Appl. No.: 17/633,839

(22) PCT Filed: Aug. 14, 2020

(86) PCT No.: PCT/EP2020/072829
§ 371 (c)(1),
(2) Date: Feb. 8, 2022

(87) PCT Pub. No.: WO2021/028558
PCT Pub. Date: Feb. 18, 2021

(65) Prior Publication Data

US 2022/0297419 A1 Sep. 22, 2022

(30) Foreign Application Priority Data

Aug. 15, 2019 (EP) ..... 19020476

(51) Int. Cl.
*B41F 23/04* (2006.01)

(52) U.S. Cl.
CPC ..... *B41F 23/0426* (2013.01)

(58) Field of Classification Search
None
See application file for complete search history.

(56) References Cited

U.S. PATENT DOCUMENTS

2007/0062397 A1* 3/2007 Gydesen ..... B41F 23/044 101/424.1
2015/0096452 A1* 4/2015 Puig ..... B41F 9/063 101/152
2019/0291428 A1* 9/2019 Yamamoto ..... B41J 11/0024

FOREIGN PATENT DOCUMENTS

DE 102009054865 A1 * 6/2011 ..... B41F 23/0426
EP 0647524 A1 4/1995
EP 3543023 A1 9/2019

OTHER PUBLICATIONS

English translation of DE 10 2009 054 865 A1 from EPO website, publication date Jun. 22, 2011. (Year: 2011).*

(Continued)

*Primary Examiner* — Leslie J Evanisko
(74) *Attorney, Agent, or Firm* — Bookoff McAndrews, PLLC

(57) ABSTRACT

A dryer unit (26), especially an intracolor dryer unit, for a printing machine is presented. It comprises a web inlet edge (34) and a web outlet edge (36) being substantially parallel to one another and defining a drying area (28) therebetween. Additionally, an air inlet and a first air outlet (38) being connected to the air inlet in an air-ducting manner are provided. The first air outlet (38) is positioned adjacent to one of the web inlet edge (34) and the web outlet edge (36) and a middle axis of the first air outlet (38) is inclined towards the respective other of the web inlet edge (34) and the web outlet edge (36) with respect to the drying area (28). Furthermore, a printing machine is described, comprising an impression drum, at least two ink application units and at least one dryer unit (26) as described above.

20 Claims, 4 Drawing Sheets

(56) References Cited

OTHER PUBLICATIONS

Figure 1:
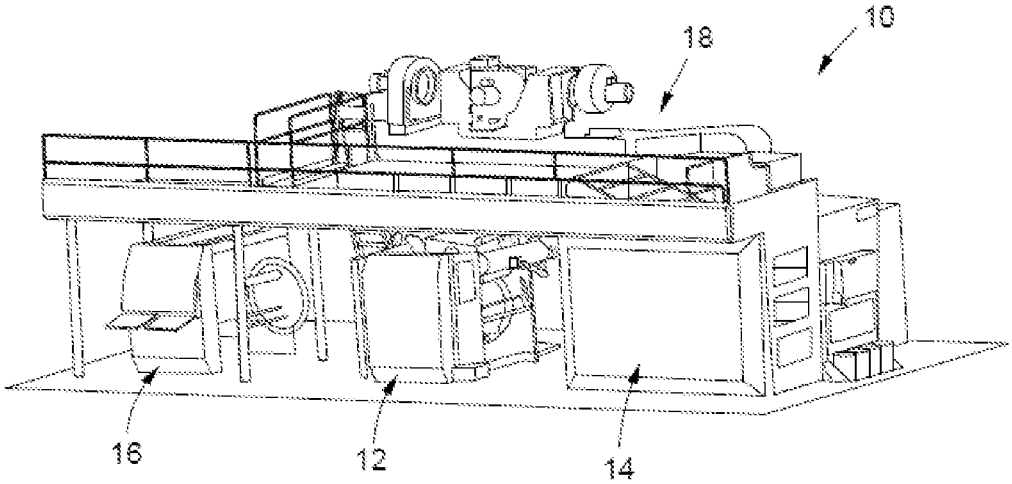

International Search Report dated Oct. 15, 2020 in International Application No. PCT/EP2020/072829 (3 pages).

* cited by examiner

DRYER UNIT FOR A PRINTING MACHINE AND PRINTING MACHINE

CROSS-REFERENCE TO RELATED APPLICATION(S)

This application is a National Stage under 35 U.S.C. § 371 of International Application No. PCT/EP2020/072829, filed Aug. 14, 2020, which claims priority to European Patent Application No. 19020476.8, filed Aug. 15, 2019, the entireties of which are incorporated herein by reference.

BACKGROUND OF THE INVENTION

The invention relates to a dryer unit, especially an intracolor dryer unit, for a printing machine, being adapted for applying a flow of air to a moving web.

Additionally, the invention relates to a printing machine, especially a flexographic printing machine, comprising an impression drum, at least two ink application units being located on a circumference of the impression drum and being adapted for applying ink to a web being located on the impression drum, and at least one dryer unit, wherein the at least one dryer unit is positioned between the two ink application units.

Dryer units for printing machines and especially intracolor dryers are known in the art. The same is true for printing machines being equipped with intracolor dryers.

Intracolor dryers derive their name from the fact that they are positioned between two ink application units, i.e. in between "two colors". The purpose of such a dryer is to dry ink of one color having been applied to a web of support material by a first ink application unit before ink of a second color is applied to the web of support material by a second ink application unit. Consequently, the drying effect of an intracolor dryer has to be precisely located such that it only is applied to ink of the first color already having been applied to the web of support material. A drying effect has to be especially avoided for ink of the second color and ink of the first color still being under application.

In order to keep the drying effect in a predefined location, known intracolor dryers actively provide warm air to this location and actively withdraw it therefrom by suction.

Additionally, the fact that the web of support material is moving at high speed inside the printing machine has to be considered. This movement tends to pull out warm air of the predefined drying location. Active suction as mentioned above is used to counteract this phenomenon.

The operation of intracolor dryers is subject to several limitations. The inflow of warm air is limited because the drying effect has to be kept local. For the same reason the travelling speed of the web is limited. The outflow or suction of air is limited since the web shall not be aspired. As a consequence thereof the output of printed web is limited.

Therefore, it is an objective of the present invention to provide an improved dryer unit, which allows for a higher output of printed web without reducing the printing quality.

BRIEF SUMMARY OF THE INVENTION

The problem is solved by a dryer unit as mentioned above, which comprises a web inlet edge and a web outlet edge, being substantially parallel to one another and defining a drying area therebetween, an air inlet adapted for receiving air to be applied to the web, and a first air outlet being connected to the air inlet in an air-ducting manner, wherein the first air outlet is positioned adjacent to one of the web inlet edge and the web outlet edge and wherein a middle axis of the first air outlet is inclined towards the respective other of the web inlet edge and the web outlet edge with respect to the drying area. In operation, the web is moving and enters the drying area next to the web inlet edge and exits the drying area next to the web outlet edge. In this context, the term "web inlet edge" designates an edge of the dryer unit, which is located adjacent to a location where the moving web enters the drying area and the term "web outlet edge" designates an edge of the dryer unit, which is located adjacent to a location where the moving web leaves the drying area. The terms "web inlet edge" and "web outlet edge", thus, do not imply that the web enters the dryer unit itself. The fact that the middle axis of the first air outlet is inclined with respect to the drying area means that an angle between the middle axis and the drying area is more than 0° and less than 90°. In other words, the middle axis of the first air outlet is oblique with respect to the drying area.

The basic idea of the invention is to use the flow of air not only for drying the ink on the web but also for concentrating the drying effect inside the drying area. Because of the inclination of the middle axis of the first air outlet, the air flowing into the drying area counteracts the effect of the moving web trying to "pull out" air from this area. This has two main advantages. Firstly, a higher flow of air may be supplied to the drying area creating a stronger drying effect. Secondly, the maximum speed at which the web may travel without "pulling out" air from the drying area may be increased. Consequently, the dryer unit according to the invention may allow higher traveling speeds of web than known dryer units. Therefore, the productivity of a printing machine equipped therewith may be increased.

The printing machine for which the dryer unit according to the invention is used is especially a flexographic printing machine.

According to a preferred embodiment of the invention a first air outlet and a second air outlet of the intracolor dryer provides a tilted design of the first and second air outlet with regards to the drying area. The advantage of this titled design of the outlet nozzles is that the supplied heated air in maintained internally in the air suction or drying area without the need to apply a negative pressure in the middle of the drying area in order to avoid the web or the printed material to lift from the cylinder. In order to achieve an "air containing effect", an angle of at least or greater than 45° of the supply air outlets to the internal of the nozzle body with respect to the drying area is necessary.

According to an embodiment, the dryer unit comprises a second air outlet being connected to the air inlet in an air-ducting manner, wherein the first air outlet is positioned adjacent to the web inlet edge and its middle axis is inclined towards the web outlet edge with respect to the drying area and wherein the second air outlet is positioned adjacent to the web outlet edge and a middle axis of the second air outlet is inclined towards the web inlet edge with respect to the drying area or vice versa. Thus, the dryer unit comprises two air outlets, each of them having a middle axis which is oriented towards the middle of the drying area. As a result thereof, the effect of concentrating the drying effect in the drying area is even bigger than in the embodiment with just one air outlet. The same is true for the effect counteracting the "pull out" of air by the moving web. Consequently, printing machines equipped with such a dryer unit are highly productive.

The dryer unit can comprise a third air outlet being connected to the air inlet in an air-ducting manner, wherein the third air outlet is oriented substantially orthogonally to the drying area and is positioned between the web inlet edge and the web outlet edge. Preferably, the web inlet edge and the web outlet edge have about the same distance from the third air outlet. In other words, the third air outlet is positioned in the middle between the web inlet edge and the web outlet edge. With the third air outlet a very uniform drying effect may be achieved in the drying area. Furthermore, the amount of air supplied to the drying area may be increased. Therefore, the drying effect is enhanced.

It is understood that the number of air outlets is not limited to three. Consequently, multiple air outlets may be arranged between the web inlet edge and the web outlet edge. In this context, a preferred variant comprises a first air outlet as defined above, a second air outlet as defined above, and more than one supplementary air outlets being arranged between the first air outlet and the second air outlet.

In the context of the present invention, all air outlets may be formed as single openings, e.g. having a substantially rectangular cross section which may have a very small height compared to its length. Alternatively, an air outlet may be formed as a group of openings, e.g. a group of bores each having a substantially circular cross section. The group of openings may also be termed a perforation.

In a further alternative, the different air outlets can be provided by different ventilation modules or blowing devices. Consequently, a first air outlet may be provided by a first ventilation module, a second air outlet by a second ventilation module etc. All ventilation modules are arranged inside the dryer unit.

Preferably, the first air outlet and/or the second air outlet and/or the third air outlet substantially extend over the entire width of the dryer unit, wherein the width is oriented in parallel to the web inlet edge or the web outlet edge. This means that the first air outlet and/or the second air outlet and/or the third air outlet have substantially the same length as the web inlet edge and the web outlet edge. The length of the web inlet edge and the web outlet edge usually is substantially the same and corresponds to the width of a web of support material on which ink is applied during the printing process. Thus, such a dryer unit allows for effective and efficient drying of ink over the entire width of a web.

According to a variant, the dryer unit has a substantially triangular cross section when regarded in the direction of the web inlet edge or the web outlet edge, wherein the drying area is located adjacent to a triangle basis of the cross section. This configuration allows for simple positioning of the dryer unit in between two ink application units, where space is very limited.

Preferably, the dryer unit is built of sheet metal. Sheet metal may be processed with standard machinery. Therefore, the production of the dryer unit is simple and cost effective. Furthermore, sheet metal is well suited for building air conduits, air inlets and air outlets.

The cross section of the dryer unit may comprise an upper portion and a lower portion, wherein the lower portion is located adjacent to the triangle basis of the cross section and the upper portion is located adjacent to a triangle top of the cross section, wherein an air inlet duct is located in the upper portion, the air inlet duct being substantially parallel to the web inlet edge or the web outlet edge. This configuration is space-saving and allows for a reliable supply of dry and warm air to the drying area.

Advantageously, the first air outlet is connected to the air inlet duct via a first air distribution duct being positioned adjacent a triangle side edge running from the triangle top to the triangle basis and/or the second air outlet is connected to the air inlet duct via a second air distribution duct being positioned adjacent to a triangle side edge running from the triangle top to the triangle basis and/or the third air outlet is connected to the air inlet duct via a third air distribution duct being positioned centrally inside the triangle. This configuration is space-saving. Additionally, the three air distribution ducts guarantee a uniform distribution of air to the different air outlets. As a consequence thereof the drying effect in the drying area is also substantially uniform.

Alternatively or additionally, the cross section comprises an upper portion and a lower portion wherein the lower portion is located adjacent to the triangle basis of the cross section and the upper portion is located adjacent to a triangle top of the cross section, wherein an air suction duct is located in the lower portion, the air suction duct being substantially oriented parallel to the web inlet edge or the web outlet edge, and wherein the air suction duct communicates with the drying area via at least one air suction opening in an air-ducting manner. Active air suction as such is usual for intracolor dryers. With this configuration the available space is efficiently used. Also the interaction of the active suction with the drying area is designed such that aspiration of the web is avoided.

If the dryer unit comprises a third air outlet, the air suction duct may be separated into two halves by the third air distribution duct.

Furthermore, the problem is solved by a printing machine as described above, comprising at least one dryer unit according to the invention wherein the drying area is oriented substantially parallel to a tangent of the impression drum. The impression drum may also be designated as central impression drum. Such a printing machine disposes of an increased drying effect when compared to known printing machines. Therefore the output of printed web may be increased with respect to the prior art.

In the printing machine the air inlet duct of the dryer unit may be connected to a central air supply system adapted for providing air to the dryer unit and/or the air suction duct of the dryer unit may be connected to a central air suction system adapted for extracting air from the dryer unit. The central air supply system and the central air suction system may be equipped with respective ventilation units allowing for active air supply and active air suction. The central air supply system may also comprise a heating unit in order to provide warm air to the dryer unit. The advantage of centralized components is that they can be provided within a certain distance from the impression drum and thus can be located in les restricted spaces.

Figure 2:
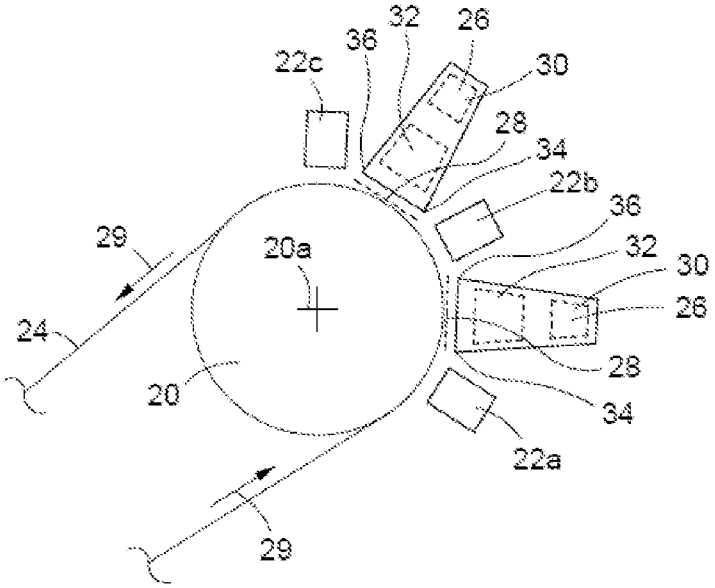
Figure 3:
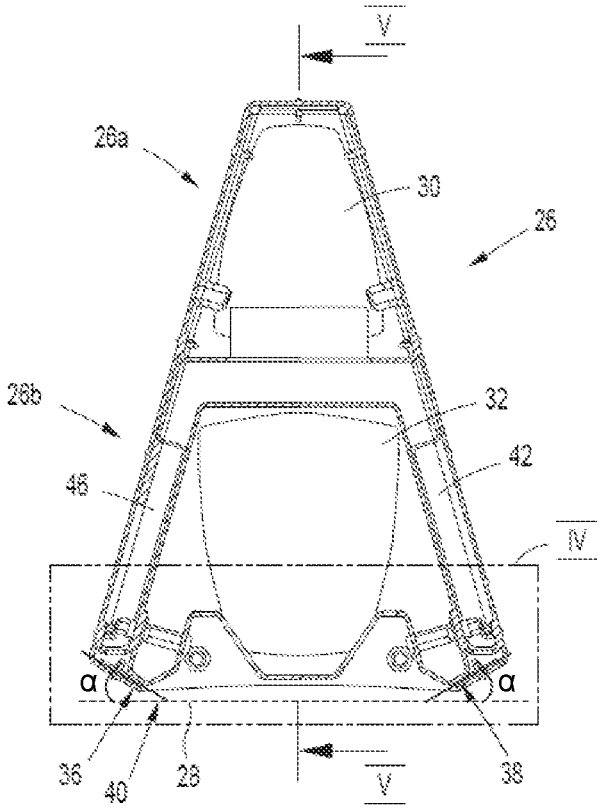
Figure 4:
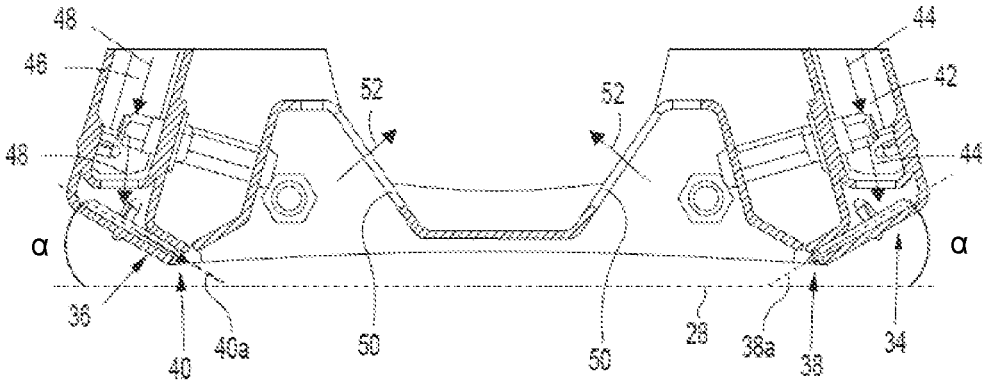
Figure 5:
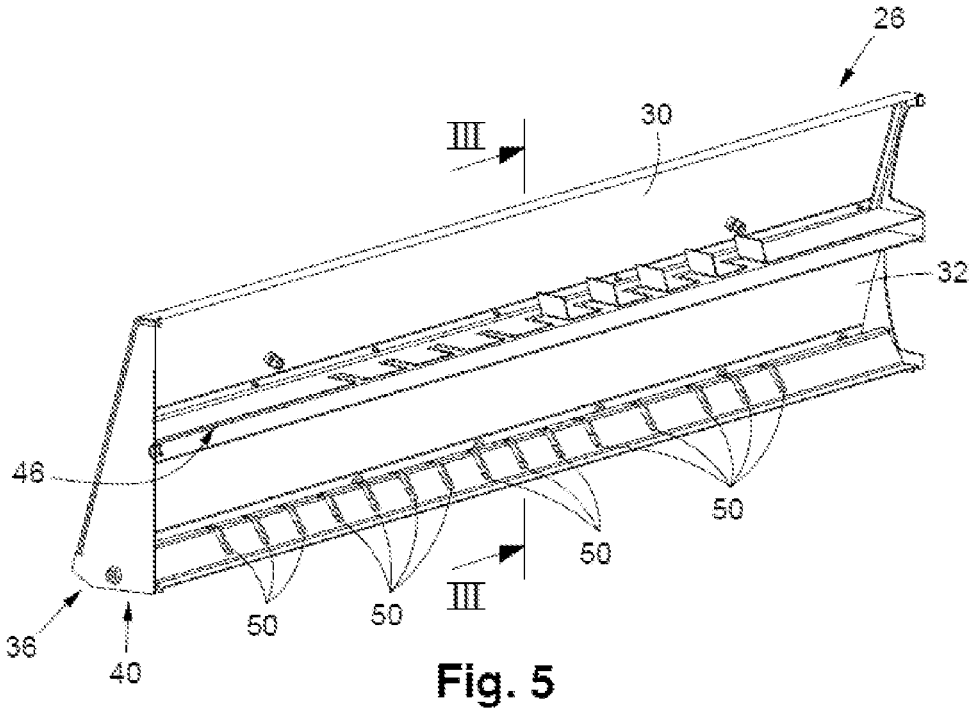
Figure 6:
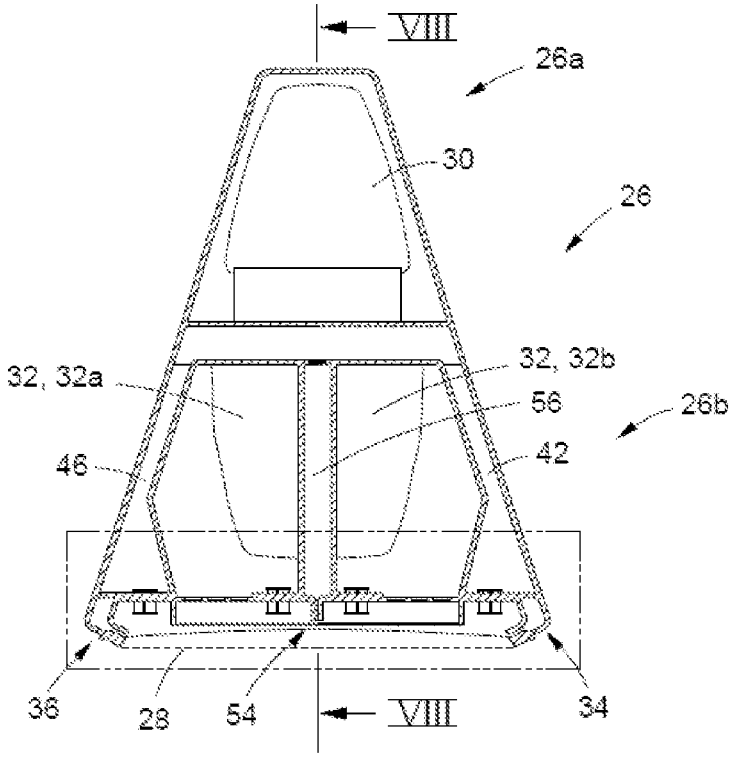
Figure 7:
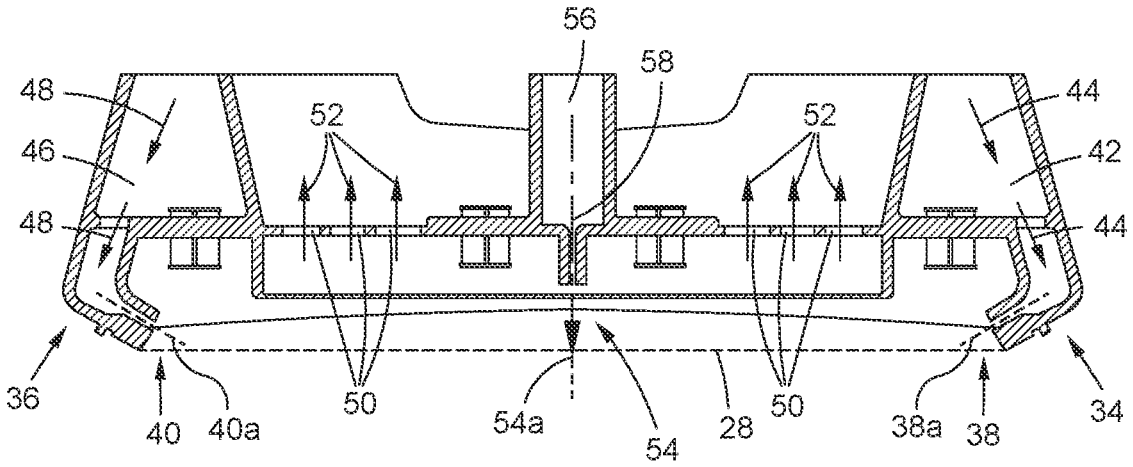
Figure 8:
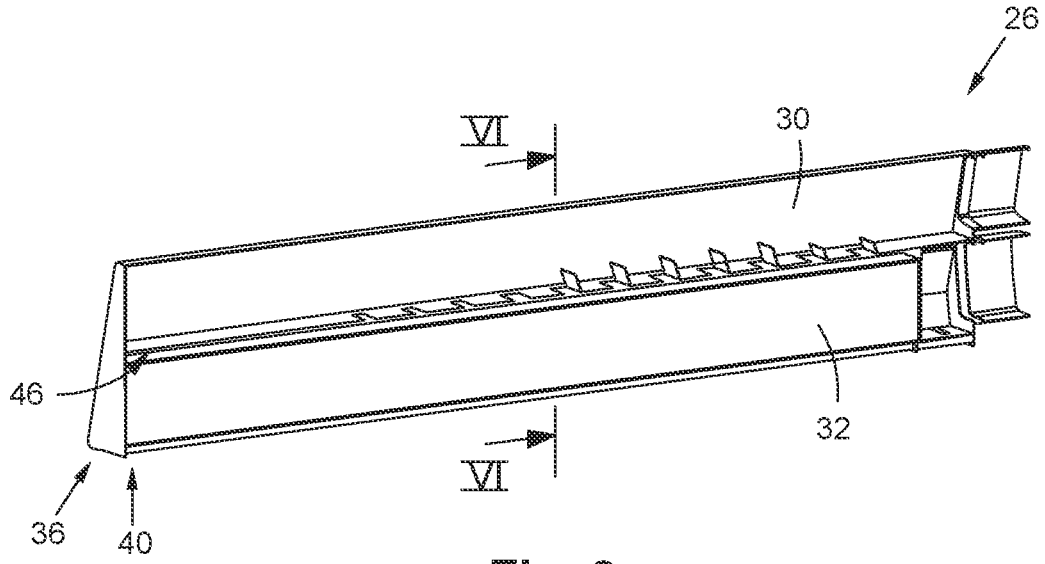

The invention will now be explained with reference to embodiments which are shown in the attached drawings. In the drawings, FIG. 1 shows a printing machine according to the invention being equipped with several dryer units according to the invention, FIG. 2 shows key elements of a printing unit of the printing machine of FIG. 1 in a schematic illustration, FIG. 3 shows a first embodiment of a dryer unit according to the invention in a sectional view III-III of FIG. 5, FIG. 4 shows a detail IV of the dryer unit of FIG. 3, FIG. 5 shows the dryer unit of FIG. 3 in a cross sectional view V-V of FIG. 3, FIG. 6 shows a second embodiment of a dryer unit according to the invention in a cross sectional view VI-VI of FIG. 8, FIG. 7 shows a detail VII of the dryer unit of FIG. 6, and FIG. 8 shows the dryer unit of FIG. 6 in a cross sectional view VIII-VIII of FIG. 6.

DETAILED DESCRIPTION

FIG. 1 shows a printing machine 10, which is a flexographic printing machine in the examples shown.

It comprises a web feeding unit 12, where a web of carrier material may be stored before the printing process takes place, a printing unit 14 adapted for printing on the web of carrier material, and a storage unit 16, where printed web is stored after the printing process.

The printing machine 10 also comprises a main dryer 18 adapted for drying printed web of carrier material after the printing process.

Further details of the printing unit 14 may be seen in FIG. 2.

As a central element the printing unit 14 comprises an impression drum 20, which is coupled to three ink application units 22*a*, 22*b*, 22*c*, each of which is adapted to apply an ink of a different color to a web 24. The ink application units 22*a*, 22*b*, 22*c* are located on a circumference of the impression drum 20.

Between each of the ink application units 22*a*, 22*b* and 22*b*, 22*c* a dryer unit 26 is provided respectively. In the example shown all dryer units 26 are designed as so-called intracolor dryers, which are adapted for drying printed web of carrier material between the application of inks of different colors.

In other words, the ink applied to the web 24 by the ink application unit 22*a* is dried by the dryer unit 26 interposed between ink application unit 22*a* and 22*b*. The ink applied to the web 24 by the ink application unit 22*b* is dried by the dryer unit 26 being interposed between ink application unit 22*b* and 22*c*.

The traveling direction of the web 24 is indicated by arrows 29.

It is understood that the number of ink application units 22*a*, 22*b*, 22*c* and the number of dryer units 26 has been chosen for illustrative purposes only.

The dryer units 26 respectively define a drying area 28, which is oriented substantially parallel to a tangent of the impression drum 20.

Every dryer unit 26 has an air inlet duct 30, which is connected to a central air supply system. This way, warm and dry air is fed to the dryer units 26, which apply it to the drying area 28. As a consequence thereof, ink on the web 24 moving through the drying area 28 is dried.

Furthermore, every dryer unit 26 has an air suction duct 32, which is connected to a central air suction system adapted for extracting air from the dryer unit and the drying area 28.

A first embodiment of the dryer unit 26 is illustrated in FIGS. 3 to 5.

In the cross sectional view of FIG. 3 the dryer unit 26 has a substantially triangular cross section when regarded in the direction of a web inlet edge 34 or a web outlet edge 36 thereof. The drying area 28 is located adjacent to a triangle basis of this cross section.

Both the web inlet edge 34 and the web outlet edge 36 extend substantially parallel to a middle axis 20*a* of the impression drum 20. Consequently, the web inlet edge 34 and the web outlet edge 36 also are substantially parallel to each other. The drying area 28 is located between the web inlet edge 34 and the web outlet edge 36.

In the vicinity of the web inlet edge 34 moving web 24 enters the drying area 28 associated with the respective dryer unit 26. In the vicinity of the web outlet edge 36 the moving web 24 leaves the drying area 28.

The air inlet duct 30 is supplied with air via an air inlet being an air duct interface on the outer surface of the dryer unit 26.

The air inlet is connected to a first air outlet 38 and a second air outlet 40 in an air-ducting manner.

The first air outlet 38 is positioned adjacent to the web inlet edge 34.

It comprises a middle axis 38*a* which is inclined towards the web outlet edge 36 with respect to the drying area 28.

The second air outlet 40 is positioned adjacent to the web outlet edge 36 and has a middle axis 40*a* which is inclined towards the web inlet edge 34 with respect to the drying area 28.

Consequently, both the first air outlet 38 and the second air outlet 40 have middle axis 38*a*, 40*a* which are inclined towards a central section of the drying area 28 at an angle $\alpha$.

As can best be seen from a combination of FIGS. 5 and 6, the first air outlet 38 and the second air outlet 40 substantially extend over the entire width of the dryer unit 26.

The triangular cross section of the dryer unit 26 may be subdivided into an upper portion 26*a* and a lower portion 26*b*, wherein the lower portion 26*b* is located adjacent to the triangle basis and the upper portion 26*a* is located adjacent to a triangle top.

The air inlet duct 30 is located in the upper portion 26*a*, wherein the air inlet duct 30 is substantially parallel to the web inlet edge 34 or the web outlet edge 36.

The first air outlet 38 is connected to the air inlet duct 30 via a first air distribution duct 42 being positioned adjacent to a triangle side edge running from the triangle top to the triangle basis. The flow of air inside the first air distribution duct 42 is illustrated by arrows 44.

The second air outlet 40 is connected to the air inlet duct 30 via a second air distribution duct 46 being positioned adjacent to a triangle side edge running from the triangle top to the triangle basis. The flow of air inside the second air distribution duct 46 is illustrated by arrows 48.

The air suction duct 32 is located in the lower portion 26*b* of the triangular cross section, wherein the air suction duct 32 is substantially parallel to the web inlet edge 34 or the web outlet edge 36.

The air suction duct 32 communicates with the drying area 28 via at least one air suction opening 50 in an air-ducting manner. The air suction flow is illustrated by arrows 52.

A second embodiment of the dryer unit 26 is shown in FIGS. 6 to 8. In the following, only the differences with respect to the first embodiment will be explained.

In a first aspect the dryer unit 26 according to the second embodiment differs from the first embodiment in that it has a third air outlet 54 being connected to the air inlet in an air-ducting manner.

The third air outlet 54 is oriented orthogonally to the drying area 28 and is positioned between the web inlet edge 34 and the web outlet edge 36. The middle axis of the third air outlet 54 is indicated by reference sign 54*a*.

In the example shown, the third air outlet 54 is positioned substantially in the middle between the web inlet edge 34 and the web outlet edge 36. It extends over the entire width of the dryer unit 26.

Like the first air outlet 38 and the second air outlet 40 the third air outlet 54 is connected to the air inlet duct 30 via a third air distribution duct 56 being positioned centrally inside the triangular cross section.

The air flow through the third air distribution duct 56 and the third air outlet 54 is illustrated by arrow 58.

The third air distribution duct 56 separates the air suction duct 32 into two halves 32*a*, 32*b*.

In a second aspect the dryer unit 26 according to the second embodiment differs from the first embodiment in that the air suction openings 50 are oriented substantially parallel to the drying area 28.

The invention claimed is:

1. A dryer unit for a printing machine, the dryer unit being adapted for applying a flow of air to a moving web and comprising:

a web inlet edge and a web outlet edge, being substantially parallel to one another and defining a drying area therebetween, an air inlet adapted for receiving air to be applied to the web, a first air outlet being connected to the air inlet in an air-ducting manner, and a second air outlet being connected to the air inlet in an air-ducting manner, wherein the first air outlet is positioned adjacent to one of the web inlet edge and the web outlet edge and wherein a middle axis of the first air outlet is inclined towards the respective other of the web inlet edge and the web outlet edge with respect to the drying area, and wherein the inclination of the middle axis towards the web outlet edge with respect to the drying area and the inclination of a middle axis of the second air outlet towards the web inlet edge with respect to the drying area is an angle of at least 45° up to 90°, wherein the dryer unit has a substantially triangular cross section when regarded in a direction of the web inlet edge or the web outlet edge, the substantially triangular cross section including a triangle top and a triangle basis, wherein the drying area is located adjacent to the triangle basis of the substantially triangular cross section, wherein the first air outlet is connected to the air inlet via a first air distribution duct being positioned adjacent to a first triangle side edge running from the triangle top to the triangle basis, wherein the second air outlet is connected to the air inlet via a second air distribution duct being positioned adjacent to a second triangle side edge running from the triangle top to the triangle basis, and wherein a middle axis of the first air distribution duct and a middle axis of the second air distribution duct correspond to a shape of the substantially triangular cross section so that a distance between the middle axis of the first air distribution duct and the middle axis of the second air distribution duct increases in a direction from the triangle top to the triangle basis.

2. The dryer unit according to claim 1, wherein the first air outlet is positioned adjacent to the web inlet edge and its middle axis is inclined towards the web outlet edge with respect to the drying area and wherein the second air outlet is positioned adjacent to the web outlet edge and the middle axis of the second air outlet is inclined towards the web inlet edge with respect to the drying area or vice versa.

3. The dryer unit according to claim 1, wherein the dryer unit comprises a third air outlet being connected to the air inlet in an air-ducting manner, wherein the third air outlet is oriented substantially orthogonally to the drying area and is positioned between the web inlet edge and the web outlet edge.

4. The dryer unit according to claim 3, wherein the first air outlet and/or the second air outlet and/or the third air outlet substantially extend over the entire width of the dryer unit, wherein the width is oriented in parallel to the web inlet edge or the web outlet edge.

5. The dryer unit according to claim 3, wherein the cross section comprises an upper portion and a lower portion, wherein the lower portion is located adjacent to the triangle basis of the cross section and the upper portion is located adjacent to a triangle top of the cross section, and wherein an air inlet duct is located in the upper portion, the air inlet duct being substantially parallel to the web inlet edge or the web outlet edge.

6. The dryer unit according to claim 5, wherein the third air outlet is connected to the air inlet duct via a third air distribution duct being positioned centrally inside the triangle.

7. The dryer unit according to claim 3, wherein the cross section comprises an upper portion and a lower portion wherein the lower portion is located adjacent to the triangle basis of the cross section and the upper portion is located adjacent to a triangle top of the cross section, wherein an air suction duct is located in the lower portion, the air suction duct being substantially oriented parallel to the web inlet edge or the web outlet edge, and wherein the air suction duct communicates with the drying area via at least one air suction opening in an air-ducting manner.

8. A printing machine comprising:

an impression drum, at least two ink application units being located on a circumference of the impression drum and being adapted for applying ink to a web being located on the impression drum, and at least one dryer unit according to claim 1, wherein the at least one dryer unit is positioned between the two ink application units, and wherein the drying area is oriented substantially parallel to a tangent of the impression drum.

9. A dryer for a printing machine, the dryer comprising:

a first air distribution duct to channel a first flow of air from an air inlet;

a second air distribution duct to channel a second flow of air from the air inlet;

a first air outlet connected to an outlet of the first air distribution duct to receive the first flow of air and expel the first flow of air toward a middle axis of the dryer; and a second air outlet connected to an outlet of the second air distribution duct to receive the second flow of air and expel the second flow of air toward the middle axis of the dryer, wherein a distance between a middle axis of the first air distribution duct and a middle axis of the second air distribution duct increases in a direction away from the air inlet along the middle axis of the dryer.

10. The dryer of claim 9, wherein:

the first air distribution duct is adjacent to a first side edge of the dryer, and the second air distribution duct is adjacent to a second side edge of the dryer.

11. The dryer of claim 9, further comprising:

a third air distribution duct to channel a third flow of air from the air inlet; and a third air outlet connected to an outlet of the third air distribution duct to receive the third flow of air and expel the third flow of air along the middle axis of the dryer in a direction substantially parallel to the middle axis of the dryer.

12. The dryer of claim 9, further comprising:

an air suction duct to suction air expelled by the first air outlet and the second air outlet, the air suction duct between the first air distribution duct and the second air distribution duct along the middle axis of the dryer.

13. The dryer of claim 12, further comprising:

a third air distribution duct to channel a third flow of air from the air inlet; and a third air outlet connected to an outlet of the third air distribution duct to receive the third flow of air and expel the third flow of air along the middle axis of the dryer in a direction substantially parallel to the middle axis of the dryer.

14. The dryer of claim 13, wherein the third air distribution duct separates the air suction duct into two halves.

15. A dryer for a printing machine, the dryer comprising:

a first air distribution duct to channel a first flow of air from an air inlet along a first side of a substantially triangular shape, the substantially triangular shape including the first side, a second side, and a third side connecting the first side to the second side, wherein the third side substantially corresponds to an area to be dried by the dryer;

a second air distribution duct to channel a second flow of air from the air inlet along the second side of the substantially triangular shape;

a first air outlet connected to an outlet of the first air distribution duct to receive the first flow of air and expel the first flow of air toward a midpoint of the third side of the substantially triangular shape; and a second air outlet connected to an outlet of the second air distribution duct to receive the second flow of air and expel the second flow of air toward the midpoint of the third side of the substantially triangular shape.

16. The dryer of claim 15, wherein:

the first air distribution duct is adjacent to a first side edge of the dryer, and the second air distribution duct is adjacent to a second side edge of the dryer.

17. The dryer of claim 15, further comprising:

a third air distribution duct to channel a third flow of air; and a third air outlet connected to an outlet of the third air distribution duct to receive the third flow of air and expel the third flow of air toward the midpoint of the third side of the substantially triangular shape in a direction substantially orthogonal to the third side of the substantially triangular shape.

18. The dryer of claim 15, further comprising:

an air suction duct to suction air expelled by the first air outlet and the second air outlet, the air suction duct between the first air distribution duct and the second air distribution duct.

19. The dryer of claim 18, further comprising:

a third air distribution duct to channel a third flow of air; and a third air outlet connected to an outlet of the third air distribution duct to receive the third flow of air and expel the third flow of air toward the midpoint of the third side of the substantially triangular shape in a direction substantially orthogonal to the third side of the substantially triangular shape.

20. The dryer of claim 19, wherein the third air distribution duct separates the air suction duct into two halves.

* * * * *